US009312624B2

(12) United States Patent
Borden et al.

(10) Patent No.: US 9,312,624 B2
(45) Date of Patent: Apr. 12, 2016

(54) SAFETY DEVICE FOR AN ELECTRICAL PLUG AND RECEPTACLE

(71) Applicants: Kelly Borden, Nisku (CA); Thompson Lorne, Nisku (CA); Erik Nosyk, Nisku (CA)

(72) Inventors: Kelly Borden, Nisku (CA); Thompson Lorne, Nisku (CA); Erik Nosyk, Nisku (CA)

(73) Assignees: HITEK URETHANE GLOBAL LTD., Nisku, Alberta (CA); AKITA DRILLING LTD., Nisku, Alberta (CA)

( * ) Notice: Subject to any disclaimer, the term of this patent is extended or adjusted under 35 U.S.C. 154(b) by 0 days.

(21) Appl. No.: 14/333,623

(22) Filed: Jul. 17, 2014

(65) Prior Publication Data

US 2015/0099379 A1 Apr. 9, 2015

(30) Foreign Application Priority Data

Oct. 3, 2013 (CA) ..... 2828842

(51) Int. Cl.
*H01R 13/44* (2006.01)
*H01R 13/639* (2006.01)

(52) U.S. Cl.
CPC ..... *H01R 13/44* (2013.01); *H01R 13/6397* (2013.01)

(58) Field of Classification Search
USPC ..... 439/133, 135, 304, 306, 307
See application file for complete search history.

(56) References Cited

U.S. PATENT DOCUMENTS

| | | | | |
|---|---|---|---|---|
| 4,824,386 | A * | 4/1989 | Souders | 439/133 |
| 5,573,412 | A * | 11/1996 | Anthony | 439/133 |
| 6,802,723 | B2 * | 10/2004 | Decime et al. | 439/135 |
| 7,021,947 | B1 * | 4/2006 | Purdy | 439/133 |
| 7,320,611 | B2 * | 1/2008 | Abbott et al. | 439/133 |
| 7,404,720 | B1 * | 7/2008 | Frey et al. | 439/133 |
| 7,462,045 | B1 * | 12/2008 | Lee | 439/133 |
| 8,262,402 | B2 * | 9/2012 | Gaul et al. | 439/304 |
| 8,979,559 | B2 * | 3/2015 | Aldrich et al. | 439/133 |
| 9,048,573 | B2 * | 6/2015 | Grzegorzewska et al. | |

OTHER PUBLICATIONS

Cooper Crouse-Hinds, Arktite Plugs, Receptacles, and Connectors, pp. 1-20. 2008 Cooper Industries , Inc., Syracuse, NY. www.crouse-hinds.com.

* cited by examiner

*Primary Examiner* — Alexander Gilman
(74) *Attorney, Agent, or Firm* — Bennett Jones LLP

(57) ABSTRACT

A safety device prevents the terminal of an electrical plug from being disengaged from or engaged with an electrical receptacle. When the terminal is engaged with the receptacle, a tubular lock-in member slides over the plug to obstruct the release of a plug securing means that secures the plug to the receptacle. A retainer member attaches to the lock-in member and engages the receptacle or a part attached to the receptacle to limit the movement of the lock-in member. When the terminal is disengaged from the receptacle, a lock-out member obstructs contact between the terminal and the receptacle and engages the plug securing means. The lock-in member obscures the plug securing means and is secured to the lock-in member by the retainer member and the keyed lockable means.

14 Claims, 7 Drawing Sheets

SAFETY DEVICE FOR AN ELECTRICAL PLUG AND RECEPTACLE

FIELD OF THE INVENTION

The present invention relates to safety devices for electrical connections, and in particular safety devices that prevent an electrical plug being disengaged from an electrical receptacle, or prevent an electrical being engaged with an electrical receptacle.

BACKGROUND TO THE INVENTION

Electrically-powered machines such as motors typically have an electrical cable connected to a conductive terminal of an electrical plug that can be engaged with an electrical receptacle of a power source to energize the machine.

It may be desirable to prevent a plug from being disengaged from a receptacle. For example, industrial receptacle panels typically have several receptacles, each of which are engaged by a plug of a different machine. If an operator mistakenly disengages the plug of a motor from the receptacle, but the plug is supposed to remain engaged, this may unexpectedly disrupt the supply of electric current to the motor.

It may also be desirable to prevent a plug from being engaged with a receptacle. For example, an operator may intentionally disengage the plug of a motor from the receptacle to prevent electrically-powered movement of a rotor while the machine is being serviced. A different operator may be unaware that the motor is being serviced and re-engage the plug of the motor with the receptacle. The unexpected supply of electric current to the motor is potentially dangerous for persons who are servicing the motor.

Accordingly, there is a need in the art for a safety device that prevents an electrical plug from being disengaged from an electrical receptacle, or that prevents an electrical plug from being engaged with an electrical receptacle. Such a device is preferably simple and economical to manufacture, and reliable and convenient in use.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

SUMMARY OF THE INVENTION

Figure 1:
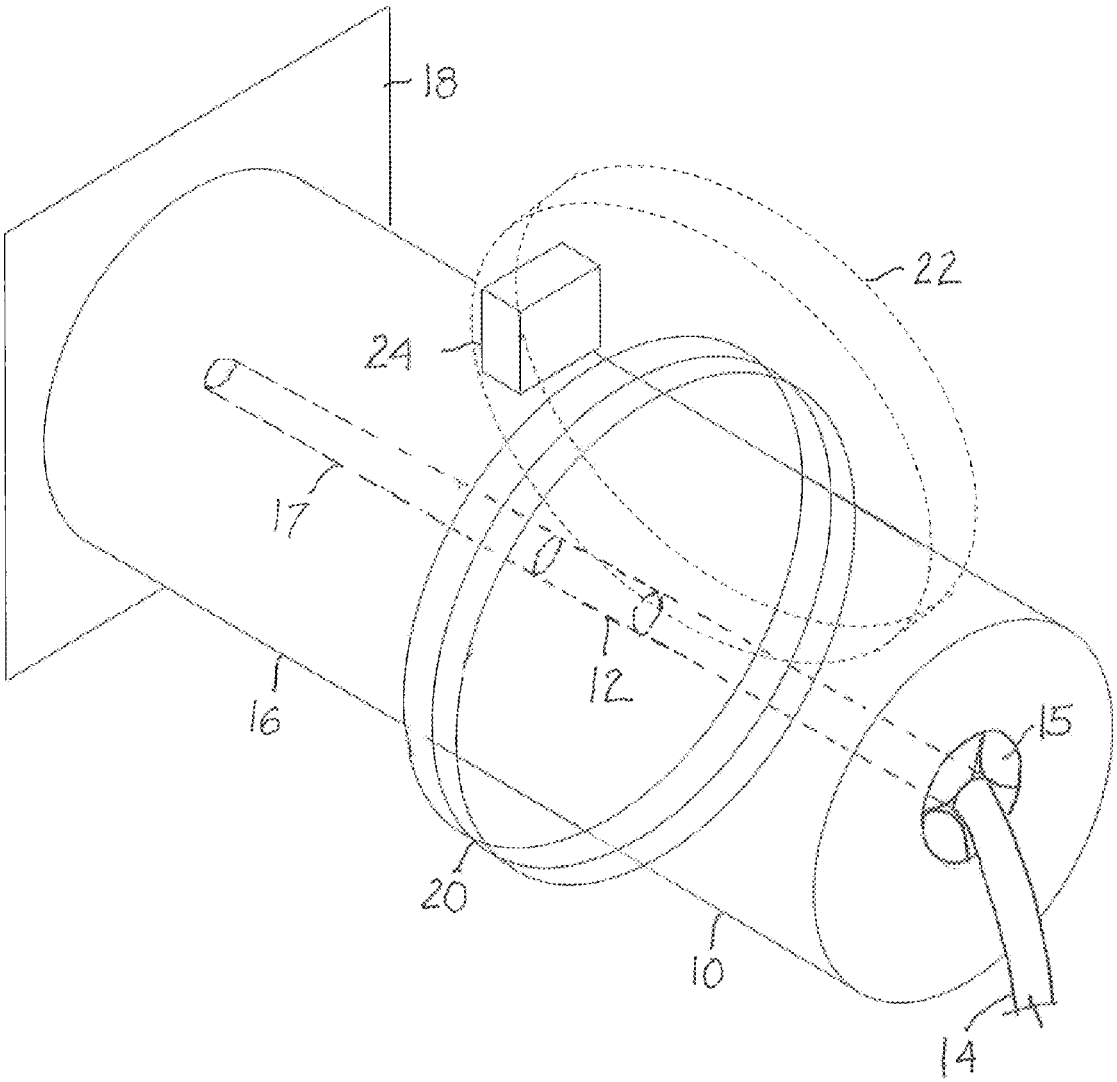
FIG. 1 PRIOR ART
FIG. 1 is a perspective view of one embodiment of an electrical plug and electrical receptacle in the prior art, with which one embodiment of the device of the present invention may be used.

In one aspect, the invention provides a safety device for use with an electrical plug having a terminal that may be releasably engaged with an electrical receptacle with a plug securing means. The device includes a tubular lock-in member that slides over the electrical plug, a retainer member, and a keyed lockable means for releasably securing the retainer member to the lock-in member. When the terminal is engaged with the receptacle with the plug securing means, the device may be placed in a lock-in mode. In the lock-in mode, the lock-in member is in a lock-in position wherein the lock-in member obstructs the release of the plug securing means. Further, the retainer member engages the receptacle or a part attached to the receptacle to prevent the lock-in member moving away from the lock-in position and the keyed lockable means secures the retainer member to the lock-in member In embodiments, the device also includes a lock-out member. The device may be placed in a lock-out mode such that the lock-out member obstructs contact between the terminal and the receptacle, the lock-out member engages the plug securing means, the lock-in member obscures the plug securing means, and the lock-out member is secured to the lock-in member by the retainer member and the keyed lockable means.

In embodiments of the above described inventions, when the device is in the lock-in mode the part attached to the receptacle that is engaged by the retainer member comprises a hinge post for a dust cap for the receptacle.

In embodiments of the above described inventions, the tubular lock-in member has an annular end wall that surrounds the plug and obscures the plug securing means when the device is in the lock-in mode or in the lock-out mode.

In embodiments of the above described inventions, the lock-out member may have a cap that covers the terminal. The cap may be perforated.

In embodiments of the above described inventions, the plug securing means may include a clamping ring with a threaded connection. The lock-out member securing means may be a threaded connection on the lock-out member that mates with the threaded connection of the clamping ring.

In embodiments of the above described inventions, the lock-in member defines at least one aperture, and the lock-out member may also define at least one aperture. The retainer member is removably insertable through the at least one aperture of the lock-in member, and may also be simultaneously insertable through the at least one aperture of the lock-out member. The keyed lockable means comprises a padlock with a shackle removably insertable through an aperture defined by the retainer member. When the device is in the lock-in mode, the retainer member passes through the at least one aperture of the lock-in member. When the device is in the lock-out mode, the retainer member simultaneously passes through the at least one aperture of the lock-in member and the at least one aperture of the lock-out member. Further, the shackle passes through the apertures and interferes with the lock-in member to prevent withdrawal of the retainer member through the at least one aperture of the lock-in member. The lock-in member may have two spaced apart projections, wherein each of the projections defines one of the apertures of the lock-in member. The lock-in member may also have a projection that defines one of the apertures of the lock-out member. The apertures may be aligned when the device is in either one or both of the lock-in mode, or the lock-out mode.

In embodiments of the above described inventions, the retainer member may include a pin, or may include a shackle of the keyed lockable means.

In embodiments of the above described inventions, either one or both of the lock-in member and the lock-out member is made of a urethane.

In addition, embodiments of the device may protect the plug and its terminal against damage from impacts when the plug is disengaged from the receptacle.

DETAILED DESCRIPTION OF PREFERRED EMBODIMENTS

The invention relates to a safety device for use with an electrical plug that may be engaged with an electrical receptacle. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the scope of the invention, as defined in the appended claims.

Electrical Plug and Electrical Receptacle

FIG. 1 shows one embodiment of an industrial electrical plug (10) and electrical receptacle (16) with which the device of the present invention may be used. It will be understood that the device of the present invention is intended to be used with standard plugs and receptacles, and any description of the plug (10) and the receptacle (16) is provided only to facilitate the description of the present invention and does not limit the embodiments of plugs and receptacles with which the device of the present invention may be used.

A conventional plug (10) has a substantially cylindrical body. At one end of the body, an exposed terminal (12) (concealed from view and shown with dashed lines) is connected within the body of the plug (10). One end of a cable (14) is attached to an electrically powered machine (not shown). The other end of the cable (14) can be inserted into the cylindrical body of the plug (10) into contact with the terminal (12), and secured in place using an internal cable grip (15).

A conventional receptacle (16) has a substantially cylindrical body. At one end of the body, an exposed terminal (17) (concealed from view and shown with dashed lines) is connected within the body of the receptacle (16) to a power source (18) such as a generator. A hinge post (24) is attached to an external surface of the body of the receptacle (16). A dust cap (22) (shown in dashed lines) is pivotally attached to the body of the receptacle (16) with a torsion spring-loaded hinge (not shown) attached to the hinge post (24). When the plug (10) is disengaged from the receptacle (16), the torsion spring pivots the dust cap (22) downwardly to cover the terminal (17).

When an operator wishes to engage the plug (10) with the receptacle (16), the operator pivots the dust cap (22) upwards, thereby exposing the terminal (17) of the receptacle (16). The operator then slides the plug (10) into engagement with the receptacle (16) to bring their respective terminals (12, 17) into contact with each other. The operator then uses a plug securing means (20) to positively engage the plug (10) with the receptacle (16). The plug securing means (20) may be any suitable device known in the art that can be used to releasably secure the plug (10) to the receptacle (20). In one embodiment, the plug securing means (20) is a clamping ring attached to the plug (10) that surrounds the cylindrical body of the plug (10) in a collar-like manner, and is prevented from sliding off of the cylindrical body by interference lugs. The clamping ring has an internal thread that mates with a compatible external thread formed circumferentially on the body of the receptacle (16). In another embodiment not shown, the plug securing means (20) may be a clamp that urges the plug (10) into engagement with the receptacle (16). In another embodiment, the plug securing means (20) may comprise a fastener such as a bolted assembly. The type of plug securing means (20) that engages the plug (10) with the receptacle (16) is not limiting of the present invention.

The Device in General

In general, the device (30) of the present invention comprises a lock-in member (32), a retainer member (62), and a keyed lockable means (76). Such a device (30) may be used in a "lock-in mode" to prevent the disengagement of a plug (10) engaged with a receptacle (16) with a plug securing means (20), as is shown in FIG. 2B.

In embodiments, the device (30) further comprises a lock-out member (48), and lock-out member securing means (56) for releasably securing the lock-out member (48) to the plug (10). Such a device (30) may also be used in a "lock-out mode" to prevent the engagement of a plug (10) that is disengaged from a receptacle (16), as is shown in FIG. 3B.

Lock-in Member and Lock-in Mode

In the lock-in mode, the lock-in member (32) is used to obstruct the plug securing means (20) from being released.

Figure 2A:
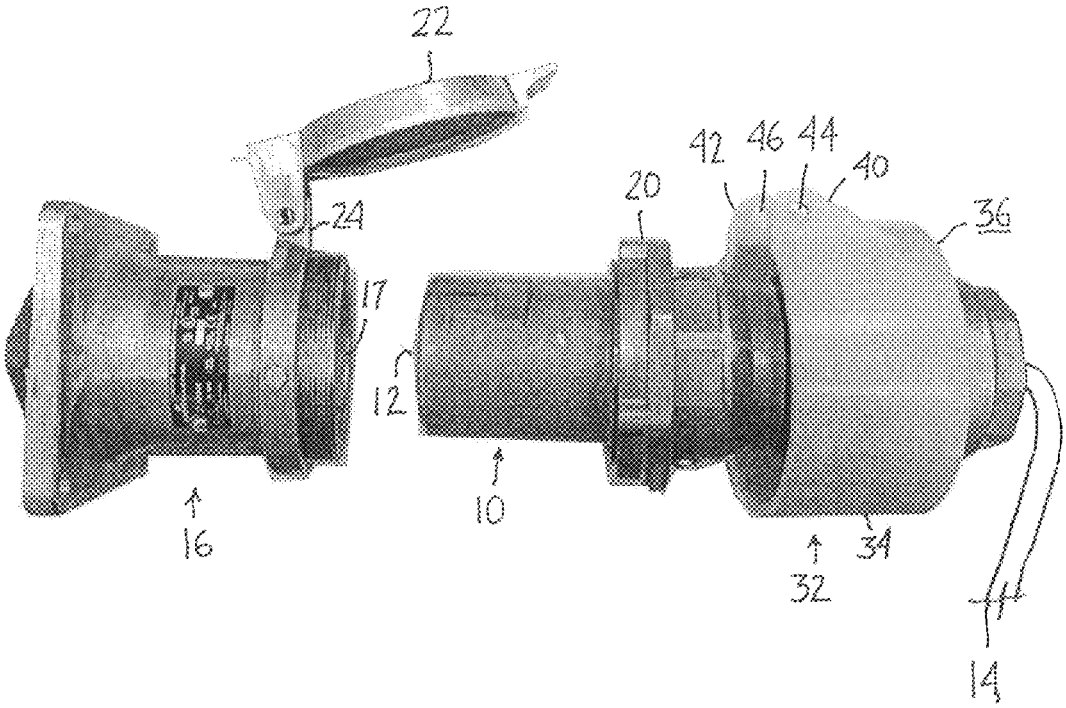
FIG. 2A is a photograph showing the relationship of the lock-in member of one embodiment of the device, a plug, and a receptacle, prior to being placed in the lock-in mode.
Figure 2B:
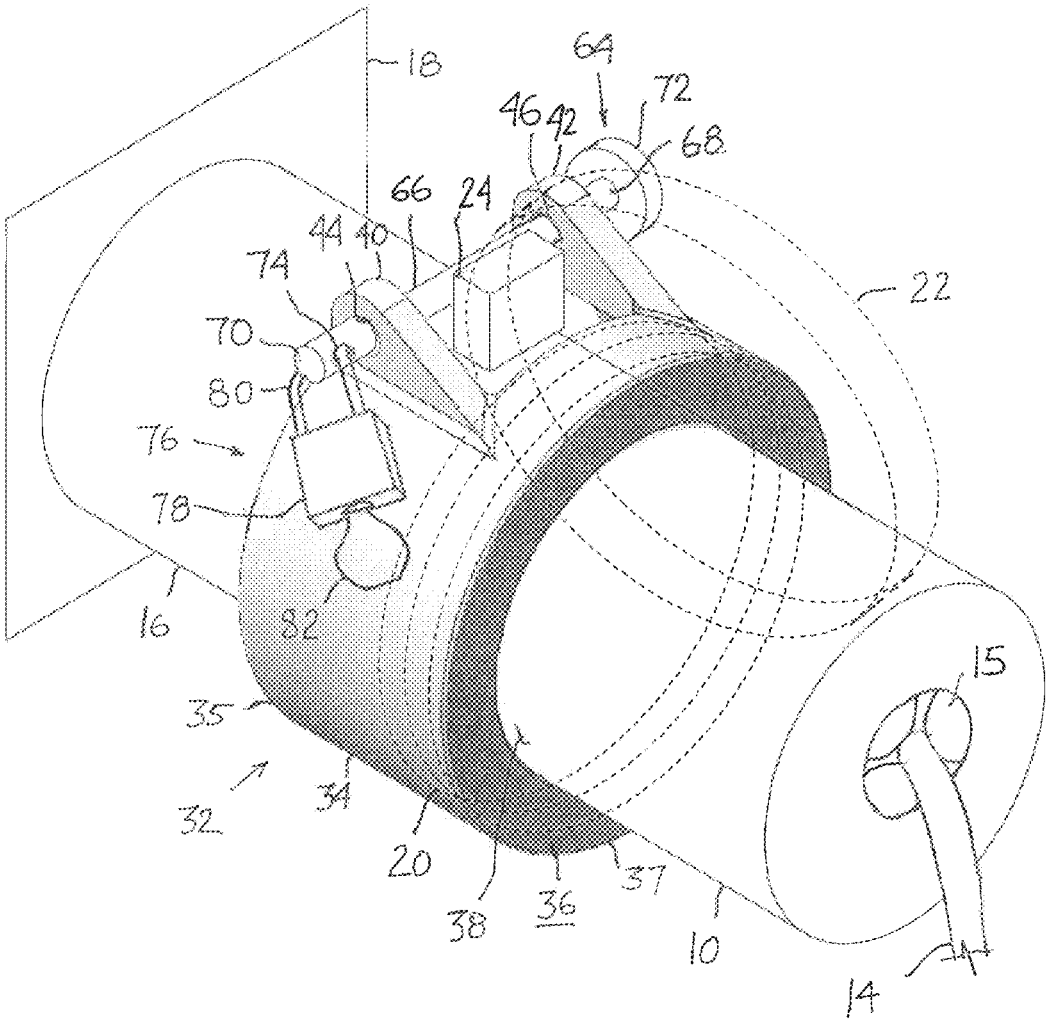
FIG. 2B. is a perspective view of one embodiment of the device of the present invention when in the lock-in mode to prevent disengagement of an electrical plug engaged with an electrical receptacle.
Figure 4:
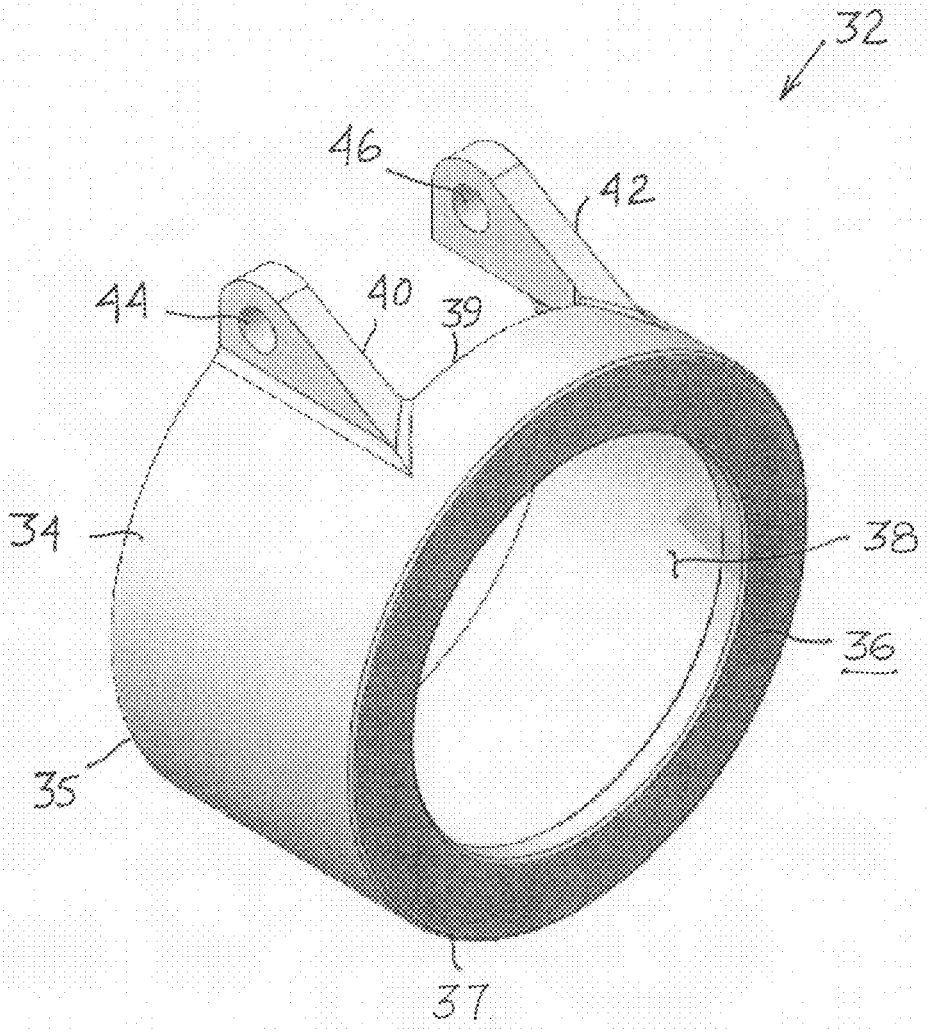
FIG. 4 is a perspective view of one embodiment of a lock-in member of the device of the present invention.

FIGS. 2A, 2B, and 4 show one embodiment of the lock-in member (32) of the present invention. In this embodiment, the lock-in member (32) has a substantially tubular body (34). At a first end (35) of the lock-in member (32), the tubular body (34) presents an unrestricted opening. At a second end (37) of lock-in member (32), the tubular body (34) has an annular end wall (36) with an end opening (38). The tubular body (34) and the end opening (38) are sized to circumferentially surround a plug (10) having a substantially cylindrical body. The annular end wall (36) is sized to obscure the clamping ring of the plug securing means (20). The tubular body (34) has a pair of projections (40, 42) that project outwardly on either side of a cut-out section (39). The projections (40, 42) define apertures (44, 46) that are collinearly aligned with each other and sized to receive the retainer member (64).

The lock-in member (32) may be made of any material that is sufficiently rigid to prevent being easily deformed including, without limitation, plastic or metal. In one embodiment, the lock-in member (32) is made of urethane.

In other embodiments of the lock-in member (32) not shown, the lock-in member (32) may have a different shape adapted to obstruct different types plug securing means (20) and to accommodate different shapes of plugs (10). Unless expressly indicated, the particular shape of the lock-in member (32) is not essential to the present invention. The lock-in member (32) may have no projections or a different number of projections. The lock-in member (32) may have no apertures or a different number of apertures for receiving the retainer member (64).

Retainer Member

The retainer member (64) is used when the device (30) is in the lock-in mode to attach to the lock-in member (32) and engage the receptacle (16) or a part attached to the receptacle (16), thereby limiting the movement of the lock-in member (32) away from a lock-in position (as will be described below).

FIG. 2B shows one embodiment of the retainer member (64) for use with the embodiments of the lock-in member (32) and the lock-out member (48). In this embodiment, the retainer member (64) comprises a rigid, substantially straight pin (66). The pin (66) is sized to pass simultaneously through the apertures (44, 46) of the lock-in member (32). At a first end (68) of the retainer member (64), an enlarged portion (72) is sized to interfere with the projection (42) of the lock-in member (32) when the pin (66) passes through the aperture (44). Near a second end (70) of the retainer member (64), an aperture (74) is formed in the pin. The retainer member (64) may be made of any of any material that is sufficiently rigid to prevent being easily deformed, including without limitation metal. In one embodiment, the retainer member (64) is made of steel.

In other embodiments of the retainer member (64) not shown, the retainer member (64) may have a different shape adapted for different shapes of lock-in members (32) and lock-out members (48). Unless otherwise indicated, the particular shape of the retainer member (64) is not essential to the present invention. By way of non-limiting example, the pin (66) may have a curved shape that fits circumferentially around a portion of a tubular body (34) of the embodiment of the lock-in member (32) (such as shown in FIG. 2) and that passes through apertures (44, 46) of the lock-in member (32) that are spaced apart circumferentially around the tubular body (34). In another example, the retainer member (64) may comprise a segment of metallic wire rope with closed loops at the terminal end, or a metallic link chain that threads through the apertures (44, 46) of the lock-in member (32) and the aperture (62) of the lock-out member (48). In another example, the retainer member (64) may comprise the shackle (80) of the padlock (78) that may be used as the keyed lockable means (76) (as will be discussed below).

Lock-Out Mode and Lock-Out Member

The lock-in member (32) is also used when the device (30) is in the lock-out mode to obstruct the lock-out-member securing means (56) from being released. As used herein, the term "obstructs" means that the lock-in member (32) hinders or prevents the release of the securing means by physically interfering with the securing means, or preventing access to or manipulation of the securing means by an operator, or a combination of both.

The retainer member (64) is also used when the device (30) is in the lock-out mode to attach to the lock-in member (32) and the lock-out member (48), thereby limiting movement of the lock-in member (32) away from a lock-in position (as will be described below).

The lock-out member (48) is used only when the device (30) is in the lock-out mode to obstruct contact between the terminal (12) of the plug (10) and the terminal (17) of the receptacle (16). As used herein, the term "obstructs" means that the lock-out member (48) physically prevents the terminals (12, 17) being in conductive contact with each other.

Figure 3A:
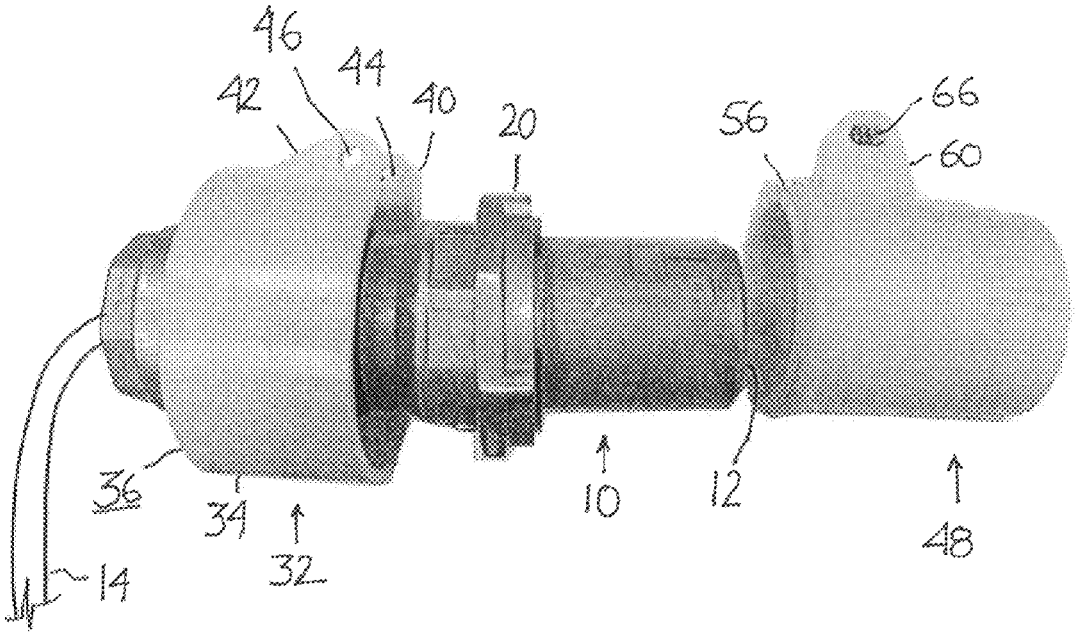
FIG. 3A is a photograph showing the lock-in member and lock-out member of one embodiment of the device, and a plug, prior to being placed in the lock-out mode.
Figure 3B:
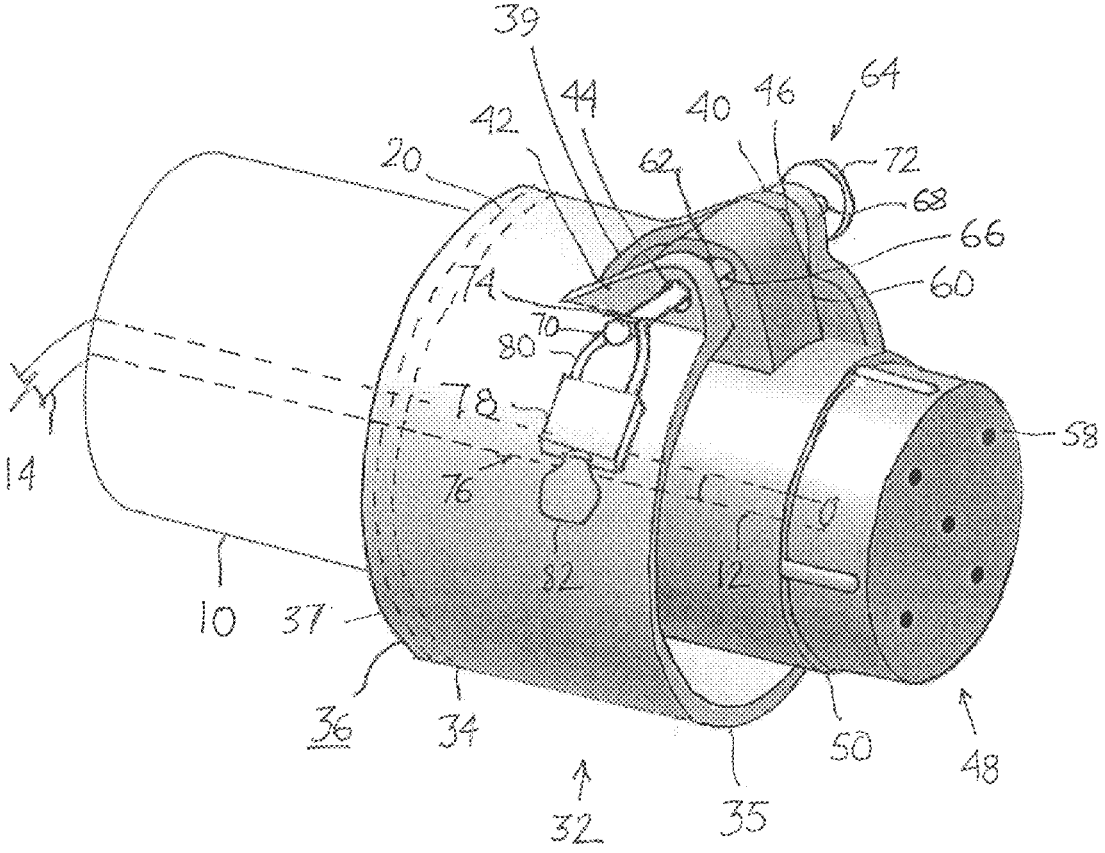
FIG. 3B is a perspective view of one embodiment of the device of the present invention when in the lock-out mode to prevent engagement of an electrical plug disengaged from an electrical receptacle.
Figure 5:
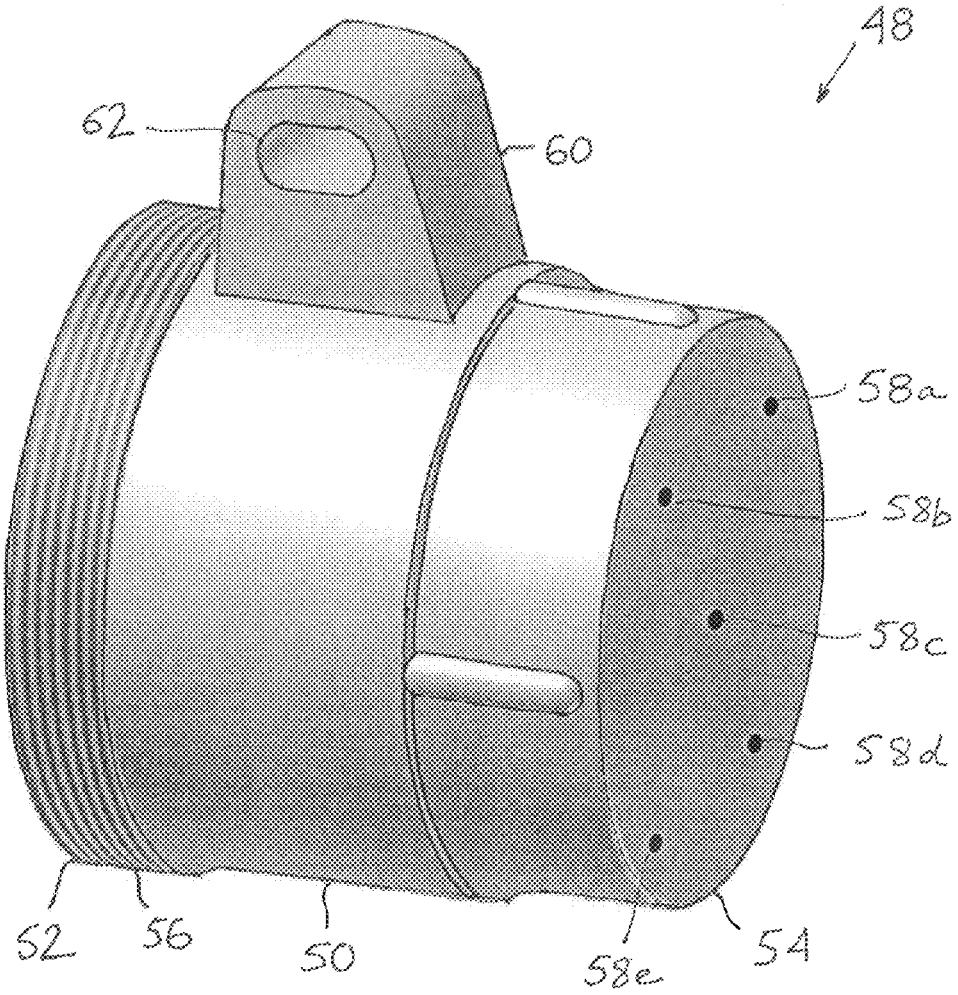
FIG. 5 is a perspective view of one embodiment of a lock-out member of the device of the present invention.

FIGS. 3A, 3B and 5 show one embodiment of the lock-out member (48). In this embodiment, the lock-out member (48) has a substantially cylindrical cap (50) that is sized to cover the terminal (12) of a plug (10). At a first end (52) of the lock-out member (48), the cap (50) has an opening that leads to hollowed interior. At a second end (54) of the lock-out member (48), the cap (50) has an end wall with a plurality of perforations (58*a* to 58*e*). The perforations (58*a* to 58*e*) allow moisture to escape from the interior of the cap (50) and prevent the formation of a vacuum in the interior of the cap (50) when the cap (50) is secured to the plug (10) or the part attached to the plug (10) by the lock-out member securing means. The lock-out member (48) has a projection (60) that projects outwardly (50) and defines an aperture (62) that is sized to receive the retainer member (64).

The lock-out member (48) may be made of any material that is sufficiently rigid to prevent being easily deformed including, without limitation, plastic or metal. In one embodiment, the lock-out member (48) is made of urethane.

In other embodiments of the lock-out member (48) not shown, the lock-out member (48) may have a different shape adapted to obstruct contact between terminals (12) having different shapes. Unless expressly indicated, the particular shape of the lock-in member (32) is not essential to the present invention. The lock-out member (48) may either completely cover the terminal (12) as in the case of the embodiment shown in FIG. 2, or may merely interfere with the terminal (12) being engaged with the terminal (17) of the receptacle (16). The lock-out member (48) may have no projections or a different number of projections. The lock-out member (48) may have no apertures or a different number of apertures for receiving the retainer member (64).

Lock-Out Member Securing Means

The lock-out member securing means (56) is used when the device is in the lock-out mode to releasably secure the lock-out member (32) in the lock-out position to the plug (10) or a part attached to the plug.

FIGS. 3A, 3B and 5 show one embodiment of the lock-out member securing means (56). In this embodiment, the lock-out member securing means (56) comprises an external thread formed circumferentially on the cap (50) near the first end (52) of the lock-out member (48). The threads mate with the internal threads of a clamping ring of the plug securing means (20).

In other embodiments of the lock-out member securing means (56) not shown, the lock-out member securing means (56) may be any suitable device known in the art that can be used to releasably secure the lock-out member (32) in the lock-out position to the plug (10) or a part attached to the plug. Examples of lock-out member securing means (56) include, without limitation, a clamp that urges the lock-out member (48) into engagement with the plug (10) or a part attached to the plug (10), or conventional fasteners such as a bolted assembly.

Keyed Lockable Means

The keyed lockable means (76) is used when the device (30) is in the lock-in mode to releasably secure the retainer member (64) to the lock-in member (32). The keyed lockable means (76) is also used when the device (30) is in the lock-out mode to releasably secure the retainer member (34) to both the lock-in member (32) and the lock-out member (48). It is not necessary that the keyed lockable means (76) absolutely prevent relative movement between the retainer member (64) and the parts attached thereto. Instead, it is sufficient that the keyed lockable means (76) sufficiently limits relative movement between the retainer member (64) and the parts secured thereto to prevent the lock-in member (32) moving away from the lock-out position or the lock-in position (as described below), as the case may be. The keyed lockable means (76) is "keyed" and lockable" in the sense that a key is required to release the retainer member (64) from the parts attached thereto. The key may be a physical device such as a toothed key, a pass card, or an electronic transmitter that mechanically interacts with the keyed lockable means (76). Alternatively, the key may be input information such as combination, or password that is necessary to actuate a physical part of the keyed lockable means (76).

FIG. 4 shows one embodiment of the keyed lockable means (76) for use with the embodiments of the lock-in member (32), the lock-out member (48), and the retainer means (64) shown in FIGS. 2 to 4. The keyed lockable means (76) comprises a padlock (78) having a shackle (80) that is lockable using a mechanical key (82). The shackle (80) is sized to pass through the aperture (74) defined by the pin (66) as shown in FIG. 4. At the same time, the shackle (80) is sized to interfere with the projections (40, 42) of the lock-in member (32) to prevent the retainer member (64) being withdrawn through the apertures (44, 46) of the projections (40, 42).

In other embodiments not shown, the keyed lockable means (76) may be any suitable device known in the art that performs the functions described above. By way of non-limiting example, the keyed lockable means (76) may comprise a combination-style padlock with a shackle, or a combination-style padlock in which a toothed pin inserts into a barrel formed from rotating discs.

Use and Operation of Device in Lock-In Mode

The use and operation of one embodiment of the device (30) in the lock-in mode to prevent disengagement of one embodiment of a plug (10) engaged with a receptacle (16) is now described with reference to FIGS. 2A, 2B and 4.

FIG. 2A shows the position of the lock-in member (32), the plug (10), and the receptacle (16) prior to the plug (10) being engaged with the receptacle (16) and the device (30) being used in the lock-in mode. One end of the cable (14) leads to an electrically-powered machine such as a motor. To install the lock-in member (32) on the plug (10), an operator slides the tubular body (34) of the lock-in member (32) over the cylindrical body of the plug (10). Subsequently, the operator inserts the free end of the cable (14) into the cylindrical body of the plug (10) into electrical contact with the terminal (12) therein, and secures the cable (14) to the plug (10) using the cable grips (15). When installed in this manner, the lock-in member (32) cannot be removed unless the free end of the cable (14) is removed from the cylindrical body of the plug (10). If the lock-in member (32) is slid towards the end of the plug (10) with the terminal (12) (i.e. to the left in FIG. 2A), then the end wall (36) of the lock-in member (32) will engage and interfere with the clamping ring (20). If the lock-in member (32) is slid off of the plug and along the cable (14) (i.e., to the right in FIG. 2A), then the machine (not shown) will prevent the lock-in member (32) being slid off of the cable (14) as the machine is too large to fit through the end opening (38).

The operator then slides the plug (10) into receptacle (16) so that their respective terminals (12, 17) come into contact. The operator then positively retains the plug (10) in the receptacle by mating the internal threads of the clamping ring (20) with the external threads of the receptacle (16), and rotating the clamping ring (20) to urge the plug (10) and the receptacle (16) together. In order to disengage the plug (10) from the receptacle (16), the operator must rotate the clamping ring and back the clamping ring towards the cable (14).

To use the device (30) in to the lock-in mode, the operator slides the tubular body (34) of the lock-in member (32) over the plug (10) toward the receptacle (16) until the interior side of end wall (36) engages the clamping ring of the plug securing means (20). When positioned in this manner, as shown in FIG. 2B, the lock-in member (32) is in a "lock-in position" in which the lock-in member (32) obstructs the release of the clamping ring of the plug securing means (20). This is because the tubular body (34) surrounds and the end wall (36) obscures the clamping ring of the plug securing means (20), thereby preventing rotation of the clamping ring by the operator. Moreover, if it were somehow possible to rotate the clamping ring off of the receptacle (16) and back it towards the cable (14), then the end wall (36) of the lock-in member (32) would interfere with the clamping ring.

The operator then inserts the retainer member (64) through apertures (46, 44) until the enlarged portion (72) of the retainer member (64) engages projection (42). The pin (66) is thus positioned between the receptacle (16) and the attached hinge post (24). Also, the aperture (74) formed in the pin (66) is located adjacent the projection (40). The operator then inserts the shackle (80) of the padlock (78) through the aperture (74) formed in the pin (66) and locks the shackle (80) into padlock (78). The device (30) is now in the lock-in mode.

In the lock-in mode, the retainer member (64) cannot be withdrawn through the apertures (44, 46). The tubular body (34) and end opening (38) of the lock-in member (32) circumferentially engage the plug (10) and the clamping ring of the plug securing means (20) to prevent the lock-in member (32) being moved transversely to the axis of the plug (10). The interior side of the end wall (36) of the lock-in member (32) engages the clamping ring of the plug securing means (20) to prevent the lock-in member (32) being moved towards the receptacle (14). The retainer member (64) engages the hinge post (24) to prevent the lock-in member (32) being moved toward the end of the plug (10) through which the cable (14) exits.

Accordingly, when the device (30) is in the lock-in mode, moving the lock-in member (32) out of the lock-in position requires the operator to use the key (82) to unlock the shackle (80) from the padlock (78) and reverse the steps used to place the device (30) in the lock-in mode. By limiting access to the key (82) to authorized persons, unauthorized persons are thereby prevented from disengaging the plug (10) from the receptacle (16).

Use and Operation of Device in Lock-Out Mode

The use and operation of one embodiment of the device (30) in the lock-out mode to prevent engagement of one embodiment of a plug (10) disengaged from a receptacle (16) is now described with reference to FIGS. 3A, 3B and 5.

FIG. 3A shows the position of the lock-in member (32), the lock-out member (48), and the plug (10) prior to the device (30) being used in the lock-out mode. It will be understood that the lock-in member (32) will already have been installed on the plug (10) in the same manner as described above for use of the device in the lock-in mode. However, the plug (10) is disengaged from the receptacle (16) and the present object is to prevent the terminal (12) of the plug (10) from being engaged with the terminal (17) of the receptacle (16).

To use the device (30) in the lock-out mode, the operator positions the cap (50) of the lock-out member (48) within the lock-in member (32), which is already positioned on the end of the plug (10). The lock-out member thus covers the terminal (12) (concealed from view and shown with dashed lines) of the plug (10). When positioned in this manner, the lock-out member (48) is in a "lock-out position" in which the lock-out member (48) obstructs contact between the terminal (12) of the plug (10) and the terminal (17) of the receptacle (16). The operator then releasably secures the cap (50) in the lock-out position to the plug (10) by using the lock-out member securing means (56). In this embodiment, the internal threads of the clamping ring of the plug securing means (20) (concealed from view and shown in dashed lines) are mated with the external threads (56) formed on the cap (50). In order to release the plug (10) from the lock-out member (48), the operator must rotate the clamping ring and back the clamping ring towards the cable (14).

The operator then slides the tubular body (34) of the lock-in member (32) over the plug (10) towards the terminal (12) until the interior side of end wall (36) engages the clamping ring of the plug securing means (32). Positioned in this manner, as shown in FIG. 3B, the lock-in member (32) is in a "lock-out position" in which the lock-in member (32) obstructs the release of the lock-out member securing means (56). This is because the tubular body (34) surrounds and the end wall (36) obscures the clamping ring of the plug securing means (20), which is threaded onto the lock-out member securing means (56), thereby preventing rotation of the clamping ring by the operator.

When the lock-in member (32) is positioned in the lock-out position, the projection (60) of the lock-out member (48) fits within the cut-out section (39) of the lock-in member (32) such that all three apertures (44, 46, 62) are aligned. The retainer member (64) may then be inserted through the apertures (44, 46, 62). When the retainer member (64) is so inserted, the aperture (74) formed in the pin (66) is located adjacent the projection (42). The operator may then lock the pin (66) in the same manner as described above for the lock-in mode. The device (30) is now in the lock-out mode.

In the lock-out mode, the retainer member (64) cannot be removed without being unlocked. The tubular body (34) and end opening (38) of the lock-in member (32) circumferentially engage the plug (10) or the clamping ring of the plug securing means (20) to prevent the lock-in member (32) being moved transversely to the axis of the plug (10). The interior side of the end wall (36) of the lock-in member (32) engages the clamping ring of the plug securing means (20) to prevent the lock-in member (32) being moved towards the end of the plug (12) with the terminal (12). The projections (40, 42) engage the retainer member (64), which in turn engages the projection (60) to prevent the lock-in member (32) being moved toward the end of the plug (10) through which the cable (14) exits.

Accordingly, when the device (30) is in the lock-out mode, moving the lock-in member (32) out of the lock-out position requires the operator to use the key (82) to unlock the shackle (80) from the padlock (78) and reverse the steps used to place the device (30) in the lock-out mode. By limiting access to the key (82) to authorized persons, unauthorized persons are thereby prevented from engaging the plug (10) with the receptacle (16).

It will further be appreciated that when the device (30) is in the lock-out mode, the lock-in member (32) and the lock-out member (48) protect the plug (10) against damage from impacts. In particular, the cap (50) of the lock-out member (48) protects the terminal (12) of the plug (10) from direct impact and from being fouled with dirt. In addition, the lock-out member (48) suspends the plug (10) within the tubular body (34) of the lock-in member (32), thereby sheltering the body of the plug (10) from direct impact if the plug (10) is dropped on its side. If the lock-in member (32) and the lock-out member (48) are made of urethane, the elasticity of the urethane may allow the force of the impact to be better absorbed and distributed over the plug (10).

As will be apparent to those skilled in the art, the scope of the claims should not be limited by the preferred embodiments set forth in the examples, but should be given the broadest interpretation consistent with the description as a whole.

What is claimed is:

1. A safety device for use with an electrical plug having a terminal that may be releasably engaged with an electrical receptacle with a plug securing means, the device comprising:

(a) a tubular lock-in member slidably disposed over the electrical plug;

(b) a retainer member;

(c) a keyed lockable means for releasably securing the retainer member to the lock-in member; and (d) a lock-out member, wherein when the terminal is engaged with the receptacle with the plug securing means, the device may be placed in a lock-in mode wherein:

(e) the lock-in member is in a lock-in position wherein the lock-in member obstructs the release of the plug securing means; and (f) the retainer member engages the receptacle or a part attached to the receptacle to prevent the lock-in member moving away from the lock-in position and the keyed lockable means secures the retainer member to the lock-in member;

and wherein when the terminal is disengaged from the receptacle, the device may be placed in a lock-out mode wherein:

(g) the lock-out member engages and obscures the plug securing means, and obstructs contact between the terminal and the receptacle; and (h) the lock-out member is secured to the lock-in member by the retainer member and the keyed lockable means.

2. The device of claim 1, wherein when the device is in the lock-in mode the part attached to the receptacle engaged by the retainer member comprises a hinge post for a dust cap for the receptacle.

3. The device of claim 1, wherein the tubular lock-in member has an annular end wall that surrounds the plug, and wherein when the device is in the lock-in mode or in the lock-out mode, the end wall obscures the plug securing means.

4. The device of claim 1 wherein the lock-out member comprises a cap that covers the terminal.

5. The device of claim 4 wherein the cap is perforated.

6. The device of claim 1 wherein the plug securing means comprises a clamping ring with a threaded connection for connecting to a threaded connection on the receptacle.

7. The device of claim 1 wherein either one or both of the lock-in member and the lock-out member are made of a urethane.

8. The device of claim 1 wherein:

(a) the lock-in member defines at least one aperture;

(b) the retainer member is removably insertable through the at least one aperture of the lock-in member;

(c) the keyed lockable means comprises a padlock with a shackle removably insertable through an aperture defined by the retainer member; and wherein when the device is in the lock-in mode:

(d) the retainer member passes through the at least one aperture of the lock-in member; and (e) the shackle passes through the aperture defined by the retainer member and interferes with the lock-in member to prevent withdrawal of the retainer member through the at least one aperture of the lock-in member.

9. The device of claim 8 wherein the lock-in member comprises two spaced apart projections, each of which defines one of the apertures of the lock-in member.

10. The device of claim 9 wherein the apertures of the lock-in member are aligned.

11. The device of claim 10 wherein the retainer member comprises a pin.

12. The device of claim 10 wherein the retainer member comprises the shackle of the keyed lockable means.

13. The device of claim 1 wherein:

(a) the lock-in member defines at least one aperture;

(b) the lock-out member defines at least one aperture;

(c) the retainer member is removably insertable simultaneously through the at least one aperture of the lock-in member and the at least one aperture of the lock-out member;

(d) the keyed lockable means comprises a padlock with a shackle removably insertable through an aperture defined by the retainer member; and wherein when the device is in the lock-out mode:

(e) the retainer member simultaneously passes through the at least one aperture of the lock-in member and the at least one aperture of the lock-out member; and (f) the shackle passes through the aperture defined by the retainer member and interferes with the lock-in member to prevent withdrawal of the retainer member through the at least one aperture of the lock-in member.

14. The device of claim 13 wherein:

(a) the lock-out member comprises two spaced apart projections, wherein each of the projections defines one of the apertures of the lock-in member;

(b) the lock-in member comprises a projection that defines one of the apertures of the lock-out member; and wherein when the device is in the lock-out mode, the apertures of the lock-in member and the aperture of the lock-out member are aligned.

* * * * *